US010378694B2

(12) United States Patent
Delanoe et al.

(10) Patent No.: US 10,378,694 B2
(45) Date of Patent: Aug. 13, 2019

(54) UNCOUPLING OF THE CORRUGATIONS OF AN IMPERVIOUS BARRIER

(71) Applicant: Gaztransport Et Technigaz, Saint Remy les Chevreuse (FR)

(72) Inventors: Sebastien Delanoe, Saint Remy les Chevreuse (FR); Marc Boyeau, Viroflay (FR); Mickael Herry, Massy (FR); Antoine Philippe, Gif sur Yvette (FR); Virginie Longuet, Montigny-le-Bretonneux (FR); Fabien Pesquet, Hanches (FR)

(73) Assignee: Gaztransport ET Technigaz, Saint Remy les Chevreuse (FR)

( * ) Notice: Subject to any disclaimer, the term of this patent is extended or adjusted under 35 U.S.C. 154(b) by 603 days.

(21) Appl. No.: 14/783,755

(22) PCT Filed: Apr. 4, 2014

(86) PCT No.: PCT/FR2014/050819

§ 371 (c)(1),
(2) Date: Oct. 9, 2015

(87) PCT Pub. No.: WO2014/167228

PCT Pub. Date: Oct. 16, 2014

(65) Prior Publication Data

US 2016/0069514 A1 Mar. 10, 2016

(30) Foreign Application Priority Data

Apr. 11, 2013 (FR) ..... 13 53262

(51) Int. Cl.
*F17C 3/04* (2006.01)
*F17C 3/02* (2006.01)
(Continued)

(52) U.S. Cl.
CPC ..... *F17C 3/027* (2013.01); *B63B 1/10* (2013.01); *B63B 35/00* (2013.01);
(Continued)

(58) Field of Classification Search
CPC ..... F17C 2270/0107; F17C 2260/011; F17C 2209/221; F17C 2203/0604;
(Continued)

(56) References Cited

U.S. PATENT DOCUMENTS 7,597,212 B2 10/2009 Yang et al.
2005/0082297 A1* 4/2005 Dhellemmes ..... B63B 3/68 220/562

FOREIGN PATENT DOCUMENTS

EP 1898143 A2 3/2008
FR 2739675 A1 4/1997
(Continued)

OTHER PUBLICATIONS

International Search Report and Written Opinion, PCT Application No. PCT/FR2014/050819; dated Mar. 3, 2015, 11 pages.

*Primary Examiner* — Allan D Stevens

(57) ABSTRACT

A Sealed and thermally insulated tank has a tank wall on a carrier structure. The tank wall has an insulating barrier, sealed barrier and an anchoring member. The sealed barrier has a first undulating metal membrane and a second undulating metal membrane which are located at one side and the other of the anchoring member, along an assembly edge which is oriented parallel with a longitudinal direction of the anchoring member. The first and the second membrane undulate with a first series of undulations which intersect with the assembly edge. Terminal undulation portions which are associated with the first series of undulations of the first membrane extend in a direction transverse to the assembly edge in the direction of the second membrane, beyond the
(Continued)

terminal undulation portions which are associated with the first series of undulations of the second membrane.

12 Claims, 7 Drawing Sheets

(51) Int. Cl.
*B63B 1/10* (2006.01)
*B63B 35/00* (2006.01)

(52) U.S. Cl.
CPC ..... *F17C 2201/0157* (2013.01); *F17C 2201/052* (2013.01); *F17C 2203/0333* (2013.01); *F17C 2203/0354* (2013.01); *F17C 2203/0358* (2013.01); *F17C 2203/0631* (2013.01); *F17C 2203/0643* (2013.01); *F17C 2203/0646* (2013.01); *F17C 2209/221* (2013.01); *F17C 2221/033* (2013.01); *F17C 2223/0161* (2013.01); *F17C 2223/033* (2013.01); *F17C 2260/011* (2013.01); *F17C 2260/013* (2013.01); *F17C 2270/0107* (2013.01); *F17C 2270/0121* (2013.01); *F17C 2270/0136* (2013.01)

(58) Field of Classification Search
CPC ..... F17C 2203/0631; F17C 2203/0646; F17C 2203/0643; F17C 13/001; F17C 3/027
USPC ..... 220/560.04, 560.05, 560.06
See application file for complete search history.

(56) References Cited

FOREIGN PATENT DOCUMENTS

| | | | |
|---|---|---|---|
| JP | 2007525624 | A | 9/2007 |
| WO | 2011157915 | A1 | 12/2011 |
| WO | 2014167228 | A2 | 10/2014 |
| WO | 2014167228 | A3 | 10/2014 |

* cited by examiner

UNCOUPLING OF THE CORRUGATIONS OF AN IMPERVIOUS BARRIER

CROSS-REFERENCE TO RELATED APPLICATION

This application is the National Stage of, and therefore claims the benefit of, International Application No. PCT/FR2014/050819 filed on Apr. 4, 2014, entitled "UNCOUPLING OF THE CORRUGATIONS OF AN IMPERVIOUS BARRIER," which was published in French under International Publication Number WO 2014/167228 on Oct. 16, 2014. International Application No. PCT/FR2014/050819 claims priority to FR Application No. 1353262 filed on Apr. 11, 2013. Both of the above applications are commonly assigned with this National Stage application and are incorporated herein by reference in their entirety.

TECHNICAL FIELD

In a tank with a folded membrane, the closure of the membrane requires a degree of flexibility in order to accept the thermal contractions and the extensions of the beam of the tanker. The first stress, the thermal contraction, requires not having a flat connection. This is because, in view of the position of the connection zones, a flat connection would impose in one direction a small distance in a planar zone but in the radial direction a large length without any waves. The thermal contractions would therefore be excessively unfavorable to validate such a solution.

The techniques with undulating membranes are based on the fact that the waves can absorb the membrane deformations under thermal loading and elongation loading of the tanker beam. In order to have satisfactory mechanical strength of the membrane, it is preferable for the rigidity of the membrane in the two directions of stress to be substantially continuous.

Document WO2011/157915 describes a membrane formed by undulating sealed plates. The sealed plates of this membrane are arranged in order to align the undulations of two adjacent sealed plates. A square aperture is produced in the region of a connection zone between two sealed plates. A support foot is arranged locally in the region of this aperture. Two closure plates form a square surface around the support foot on which there are anchored the two adjacent undulating plates which have been perforated in order to form the aperture. The undulations of the interrupted sealed plates by the square aperture are closed in the region of the square aperture by caps.

SUMMARY

A notion on which the disclosure is based is to produce the sealed connection of two mutually undulating membranes without creating a zone with a heavy concentration of stresses.

According to an embodiment, the disclosure provides for a sealed and thermally insulated tank comprising a tank wall on a carrier structure, the tank wall comprising from the outer side to the inner side an insulating barrier which is retained on the carrier structure, the insulating barrier covering an inner surface of the carrier structure and a sealed barrier which rests on the insulating barrier, an elongate sealed metal anchoring member being fixed to an upper surface of the insulating barrier, the sealed barrier comprising: a first undulating metal membrane which is arranged on a first portion of the insulating barrier located at one side of the anchoring member, a second undulating metal membrane which is arranged on a second portion of the insulating barrier located at the other side of the anchoring member and a first and a second plurality of caps, the first membrane having an assembly edge which is oriented parallel with a longitudinal direction of the anchoring member and which is arranged on the anchoring member, the assembly edge of the first membrane being welded in a sealed manner to the anchoring member, the first membrane undulating with a first series of parallel undulations and a second series of parallel undulations, the respective directions of the two series of undulations intersecting, the first series of undulations extending in a direction which intersects with the assembly edge of the first membrane, each undulation of the first series of undulations of the first membrane being closed in a sealed manner by a cap of the first plurality of caps which is arranged along the assembly edge, the second membrane undulating with a first series of parallel undulations and a second series of parallel undulations, the respective directions of the two series of undulations intersecting, the first series of undulations extending in a direction which intersects with the assembly edge of the second membrane, each undulation of the first series of undulations of the second membrane being closed in a sealed manner by a cap of the second plurality of caps which is arranged along the assembly edge, the assembly edge of the second membrane being profiled so as to comprise along the anchoring member advanced portions which cover the first membrane and recessed portions which are located in the continuation of the first series of undulations of the first membrane in order to expose sealed zones of the anchoring member, the cap of the first plurality being arranged each time so as to overlap the first membrane and the exposed sealed zone of the anchoring member, the advanced portions being located in the alignment of the first series of undulations of the second membrane, the cap of the second plurality being arranged each time so as to overlap the advanced portion of the second membrane and the first membrane, each of the caps comprising a metal component which has a terminal undulation portion in the form of a dome, which is intended to be connected to the respective undulation which the cap closes and which descends as far as a base plate which surrounds the terminal undulation portion, the terminal undulation portions associated with the first series of undulations of the first membrane extending in a direction transverse to the assembly edge in the direction of the second membrane, beyond the terminal undulation portions associated with the first series of undulations of the second membrane.

As a result of these features, it is possible to produce independently the first undulating membrane and the second undulating membrane and to connect them in a sealed manner without having the need to precisely align the undulations of the two membranes, which greatly facilitates their positioning. Furthermore, the sealed membrane retains flexibility in the connection zone whilst retaining the closure of the undulations for the sealing action.

According to embodiments, such a sealed and thermally insulated tank may comprise one or more of the following features.

According to an embodiment, the undulations of the first series of undulations of the second membrane are not aligned with the undulations of the first series of undulations of the first membrane in order to form an offset in a direction parallel with the assembly edge in which the offset is equal to half of the spacing of the undulations of the first series of undulations of the first membrane.

According to one embodiment, the width of an advanced portion of the second membrane is less than the distance between two undulations of the first series of undulations of the first membrane.

As a result of these features, the assembly of the two sealed membranes is facilitated.

According to an embodiment, the disclosure also provides for a sealed and thermally insulated tank which comprises a tank wall on a carrier structure, the tank wall comprising from the outer side to the inner side an insulating barrier which is retained on the carrier structure, the insulating barrier covering an inner surface of the carrier structure and a sealed barrier resting on the insulating barrier, an elongate sealed metal anchoring member being fixed to an upper surface of the insulating barrier, the sealed barrier comprising: a first undulating metal membrane which is arranged on a first portion of the insulating barrier located at one side of the anchoring member, a second undulating metal membrane which is arranged on a second portion of the insulating barrier located at the other side of the anchoring member and a first and a second plurality of caps, the first membrane having an assembly edge which is oriented parallel with a longitudinal direction of the anchoring member and which is arranged on the anchoring member, the assembly edge of the first membrane being welded in a sealed manner to the anchoring member, the first membrane undulating with a first series of parallel undulations and a second series of parallel undulations, the respective directions of the two series of undulations intersecting, the first series of undulations extending in a direction which intersects with the assembly edge of the first membrane, each undulation of the first series of undulations of the first membrane being closed in a sealed manner by a cap of the first plurality of caps which is arranged along the assembly edge, the second membrane having an assembly edge which is oriented parallel with the longitudinal direction of the anchoring member and which is arranged on the anchoring member, the assembly edge of the second membrane being welded in a sealed manner to the anchoring member, the second membrane undulating with a first series of parallel undulations and a second series of parallel undulations, the respective directions of the two series of undulations intersecting, the first series of undulations extending in a direction which intersects with the assembly edge of the second membrane, each undulation of the first series of undulations of the second membrane being closed in a sealed manner by a cap of the second plurality of caps which is arranged along the assembly edge, the anchoring member comprising a series of rectangular anchoring plates which are aligned in the longitudinal direction of the anchoring member, the sealed barrier further comprising a series of fitted undulating connection components, each fitted undulating connection component of the series comprising an elongate shell in the form of a dome which is closed at the two ends thereof and which descends as far as a base plate which completely surrounds the elongate shell, each anchoring plate of the series comprising two transverse edges the assembly edge of the first membrane being profiled in order to comprise a series of notches along the anchoring member, the assembly edge of the second membrane being profiled in order to comprise a series of notches along the anchoring member, a notch of the first membrane and a notch of the second membrane being positioned in the alignment of a transverse interface between two adjacent anchoring plates, in order to expose the transverse interface, each fitted undulating connection component of the series being arranged in the region of a transverse interface of two anchoring plates, so that the elongate shell overlaps the transverse interface, the corresponding notch of the first membrane and the corresponding notch of the second membrane, each of the caps comprising a metal component which has a terminal undulation portion in the form of a dome, which is intended to be connected to the respective undulation which the cap closes and which descends as far as a base plate which surrounds the terminal undulation portion, the end portions of the shell extending in the transverse direction of the anchoring member in the direction of the first membrane beyond the terminal undulation portions of the first series of undulations of the first membrane and in the direction of the second membrane beyond the terminal undulation portions of the first series of undulations of the second membrane.

As a result of these features, the sealed membrane retains flexibility in the connection zone whilst retaining the closure of the undulations for the sealing action.

According to an embodiment, an elongate shell comprises a central undulation which is closed by two caps, the caps comprising a metal component which has a terminal undulation portion in the form of a dome and which is connected to an end of the central undulation.

As a result of these features, the connection component has the features of an undulation, in particular the flexibility, and it is simple to produce.

According to an embodiment, the central undulation of the elongate shell is rectilinear.

According to an embodiment, the first membrane and the second membrane define two planes which intersect at an angle $\alpha$, wherein the central undulation of the fitted wave comprises rectilinear undulation portions which are separated by a bellows, the bellows returning the direction of a first portion of the central undulation in the direction of a second portion of the central undulation through the angle $\alpha$.

As a result of these features, it is possible to retain flexibility at the connection of two faces of membranes which form a dihedron.

According to an embodiment, the transverse edges of the anchoring plate are parallel with the first series of undulations of a membrane.

As a result of these features, the forces perpendicular to the undulation direction are integrally absorbed by the undulation of the membrane and the fitted undulating connection component.

According to an embodiment, a notch of the assembly edge of a membrane is oriented perpendicularly to the assembly edge. As a result of these features, the stresses oriented in the direction of the assembly edge are absorbed in the zone in which the undulations of the membrane and that of the fitted undulating connection component are alternating.

According to an embodiment, a width of a notch of the series of notches of the assembly edge of a membrane is greater than a width of the interface between two adjacent anchoring plates, the width of a notch being less than a width of a fitted undulating connection component.

As a result of these features, the contraction accepted by the membrane in the region of a notch is greater than that of the anchoring member, limited by the width of the interface between two plates.

According to an embodiment, a notch of the assembly edge of a membrane is parallel with the interface between two adjacent anchoring plates.

As a result of these features, the membrane accepts the same compression threshold over the entire depth of the notch.

According to an embodiment, the shell of the fitted undulating connection component comprises two bounded walls which have a spacing between the walls uniform over the length.

As a result of these features, the reaction to the forces of the fitted undulating connection component in the rectilinear zones of the walls is uniform.

According to an embodiment, the first series of undulations of the membranes is perpendicular to the assembly edge of the membranes.

As a result of these features, the sealed membrane has an optimum behavior when it is urged by stresses in the longitudinal direction of the anchoring member.

According to an embodiment, each undulation of the first series of undulations of the first membrane comprises a first rectilinear portion, a bend and a second rectilinear portion, and wherein the bend has an angle which is capable of orientating the second rectilinear portion perpendicularly to the assembly edge of the first membrane with the anchoring member.

As a result of these features, when two walls which form a non-orthogonal dihedron are joined, the undulations arrive perpendicularly to the straight intersection line at the two planes and the longitudinal orientation of the anchoring member.

According to an embodiment, the direction of the second series of undulations of the second membrane is parallel with the direction of the second series of undulations of the first membrane.

According to an embodiment, the first series of undulations of a membrane is perpendicular to the assembly edge of the membrane and the second series of undulations of the membrane is parallel with the assembly edge of the membrane.

As a result of these features, the undulations of the second series do not intersect with the assembly edge and do not require terminal caps on this assembly edge. Furthermore, the two series of undulations define a regular and uniform grid of the membrane which allows stresses to be supported in all the directions of the plane defined by the membrane.

According to an embodiment, the direction of the first series of undulations of the second membrane is parallel with the direction of the first series of undulations of the first membrane.

As a result of these features, the reaction to the orthogonal forces by the first and second series of undulations is identical.

According to an embodiment, the undulations of the first series of undulations of the membranes are spaced at regular intervals.

As a result of these features, the behavior of the membrane, in particular with respect to the thermal contraction forces, is homogeneous over all of the membrane.

Such a tank may be part of a ground-based storage installation, for example, for storing LNG, or may be installed in a floating structure, at the coast or in deep water, in particular a methane tanker, a floating storage and regasification unit (FSRU), an offshore floating production and storage unit (FPSO) and the like.

According to an embodiment, a tanker for the transport of a cold liquid product comprises a double hull and an above-mentioned tank which is arranged in the double hull.

According to an embodiment, the disclosure also provides for a method for loading or unloading such a tanker, in which a cold liquid product is conveyed through insulated channels from or to a floating or ground-based storage installation to or from the tank of the tanker.

According to an embodiment, the disclosure also provides for a transfer system for a cold liquid product, the system comprising the above-mentioned tanker, insulated channels which are arranged so as to connect the tank which is installed in the hull of the tanker to a floating or ground-based storage installation and a pump for driving a flow of cold liquid product through the insulated channels from or to the floating or ground-based storage installation to or from the tank of the tanker.

Some aspects of the disclosure are based on the notion of being able to use standard elements in order to produce the connection of the membrane.

Some aspects of the disclosure are based on the notion of producing in series blocks which are equipped in the factory or on the on-board construction site, comprising a carrier structure, an insulating barrier and a sealed membrane, with a peripheral zone of the carrier structure left free for the assembly by means of welding with an adjacent block. Some aspects of the disclosure are based on the notion after the assembly of two blocks of filling the assembly space with insulation, then carrying out the closure of the sealed membrane. Some aspects of the disclosure are based on the notion of producing an intentional offset in the plane of the membranes between the membranes of two adjacent blocks in order to enable, even in the case of complementary play, the waves of the closure component to be positioned between two waves.

BRIEF DESCRIPTION OF THE DRAWINGS

The disclosure will be better understood and other objectives, details, features and advantages thereof will be appreciated more clearly from the following description of several specific embodiments of the disclosure, given purely by way of non-limiting illustration, with reference to the appended drawings, in which.

DETAILED DESCRIPTION

Figure 1:
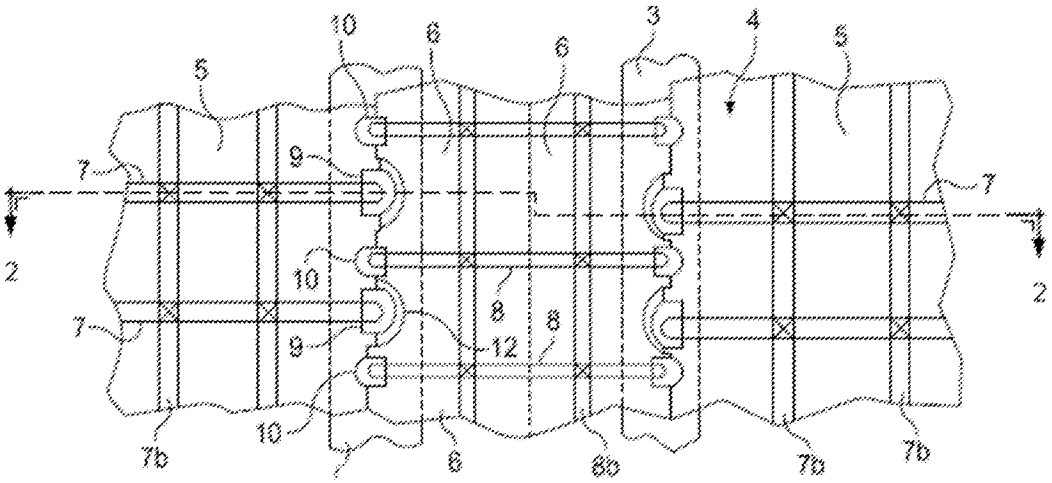
FIG. 1 is a schematic plan view illustrating a sealing membrane in a planar connection zone.

In this description, the terms above, upper or on are intended to refer to parts which are toward the inner side of the tank, and the terms below, lower or under are intended to refer to parts which are toward the outer side of the tank, independently of the gravitational field.

In the different variants illustrated in the drawings, the components that perform the same function have been given the same reference numerals, even if their production has been slightly modified.

Figure 2:
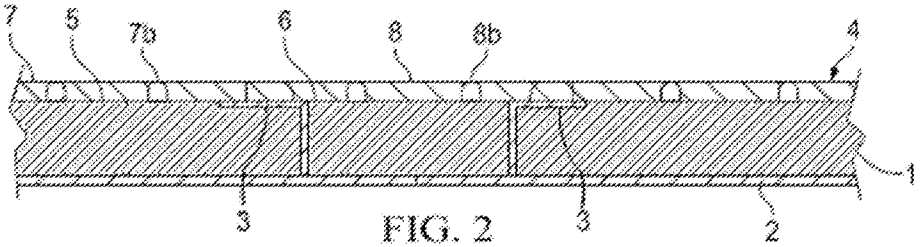
FIG. 2 is a sectioned view of a tank wall according to section 2-2 of FIG. 1.
Figure 3:
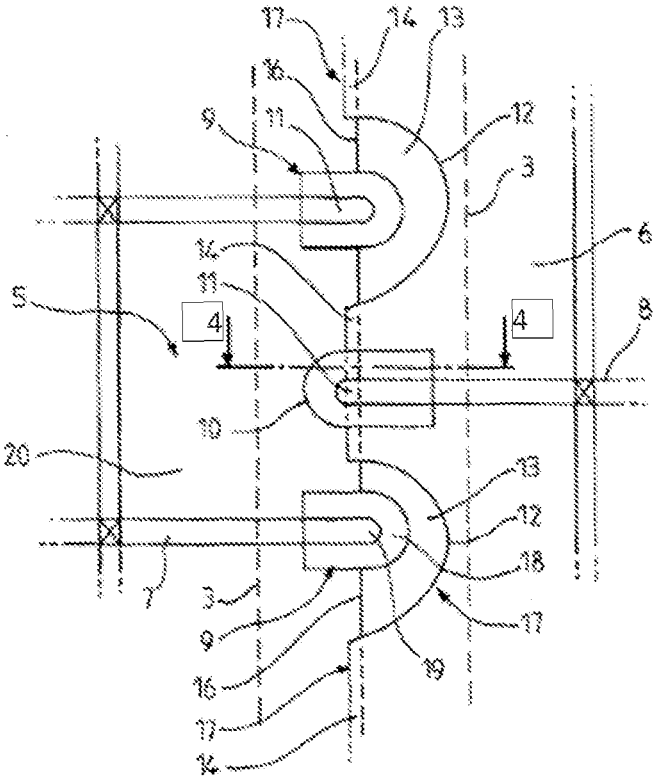
FIG. 3 is a plan view of a detail of FIG. 1.

With reference to FIGS. 1 to 3, one embodiment of a tank wall will be described which successively comprises from the outer side to the inner side a carrier wall, an insulating barrier and a sealing barrier. With reference to the drawings, it can be seen that an insulating block of the thermal insulating barrier of the tank wall has been generally designated 1. This insulating barrier 1 rests on the carrier wall 2. The insulating barrier 1 supports a sealed barrier which is alternatively called a sealed membrane and which is generally designated 4. The sealed barrier 4 is connected to the insulating barrier 1 via planar anchoring members 3.

In the direction from the carrier wall 2 toward the inner side of the tank, the insulating barrier 1 is a sandwich composed of two plates of plywood, which are separated by an insulator of the polyurethane foam type. The planar anchoring members 3, in this embodiment, are fixed to the upper plywood plate. These planar anchoring members 3 are arranged in the region of the edges of the metal sheets 5 and 6, forming the sealed barrier 4, in order to enable the welding of the edge of a metal sheet 5, which partially covers a planar anchoring member 3.

A metal sheet 5 comprises undulations 7 which confer a degree of flexibility on the sealing barrier, which is subjected to stresses. This is because it is advantageous to have a relatively flexible membrane, whether it be to limit the anchoring forces of this membrane or to absorb exceptional stresses, for example, a shell deformation, such as the elongation of the beam of the tanker, or contraction resulting from the temperature of the cold liquid stored. During the thermal contraction and elongation of the tanker beam, the waves unfold and place less stress on the fastening zones. Inter alia, this eliminates the requirement for strong anchoring of the membrane on the hull.

These undulations 7, in one embodiment, extend from one edge to the opposing edge of the metal sheet 5. In the zone of the planar anchoring member, the undulations 7 are interrupted by a terminal element, which will be referred to as caps 9. Using these caps 9, the undulations 7 are hermetically closed in order to ensure the sealing of the sealed barrier 4 in the edge zone of a metal sheet 5 and the undulations 7.

In the same manner as the metal sheet 5, the metal sheet 6 partially covers the planar anchoring members 3. Furthermore, the edge 17 of the metal sheet 6 overlaps the edge of the metal sheets 5 in the assembly zone. In this manner, the edge of a metal sheet 6 conforms to the planar anchoring member 3 and the metal sheet 5 and comprises a recess 15, which enables the thickness of the metal sheet 5 to be compensated for in the overlap zone 14. The two metal sheets 5 and 6 are together welded in a sealed manner in the portions, which are in contact. For the production, the metal sheet 6 may have a stamped strip, which is offset toward the inner side in the direction of thickness relative to the plane of the metal sheet 6 in order to cover the edge of an adjacent metal sheet 5.

A metal sheet 6 also comprises rectilinear undulations 8 over the entire length of the metal sheet 6. The undulations 8 may be similar to the undulations 7 of the metal sheet 5. This is because they perform the same functions as those of the undulations 7. To this end, these undulations 8 are oriented parallel with the undulations 7 in order to be able to ensure a continuity and a homogeneity of behavior of the membrane over the entire surface of the wall of the tank. Furthermore, each undulation 8 may be arranged between two undulations 7 in order to allow the alignment of the undulations 8 with the undulations 7 to be dispensed with. Taking a pitch to be the distance between two undulations 7, the undulations 8 are optionally offset by a half-pitch relative to an undulation 7. Finally, in the same manner as the undulations 7, the undulations 8 are closed using caps 10, ensuring the sealing of the sealed barrier 4.

In order to ensure the continuity of absorption of forces, in the connection zone of the metal sheets 5 and 6, each cap 9 extends an undulation 7 beyond the edge 16 of the metal sheet 5, between two undulations 8. To this end, a cap 9 comprises a peripheral base 18, which conforms to and is in contact with the planar anchoring member 3 in a space, which forms an aperture 13 of the planar anchoring member 3 which is not covered by the metal sheets 5 and 6. The peripheral base 18 further overlaps the planar portion 20 of the metal sheet 5. Furthermore, the cap 9 comprises an undulation portion 11 which at one side conforms to the undulation 7 of the metal sheet 5 and progressively descends as far as the peripheral base in a direction oriented away from the metal sheet 5 toward the metal sheet 6. This termination of the cap 9, in one embodiment, forms a type of dome. In a variant, other forms of termination may be adopted, such as that of a planar cut face.

In the same manner as the cap 9, each cap 10 extends an undulation 8 beyond the edge 17 of the metal sheet 6, between two undulations 8. In this manner, in accordance with the orientation of the assembly edge, there is overlapping of the undulations 7 and 8, which increases the density of undulations which is capable of receiving the forces on the sealed membrane in the assembly zone of two adjacent metal sheets 5 and 6.

Figure 4:
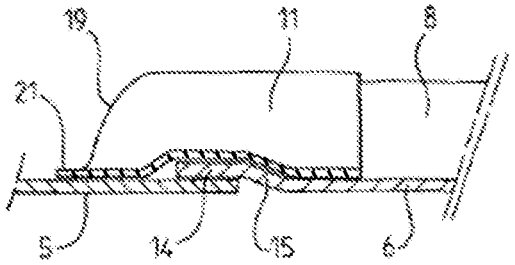
FIG. 4 is a detail of the profile of a cap along the section 4-4 of FIG. 3.
Figure 5:
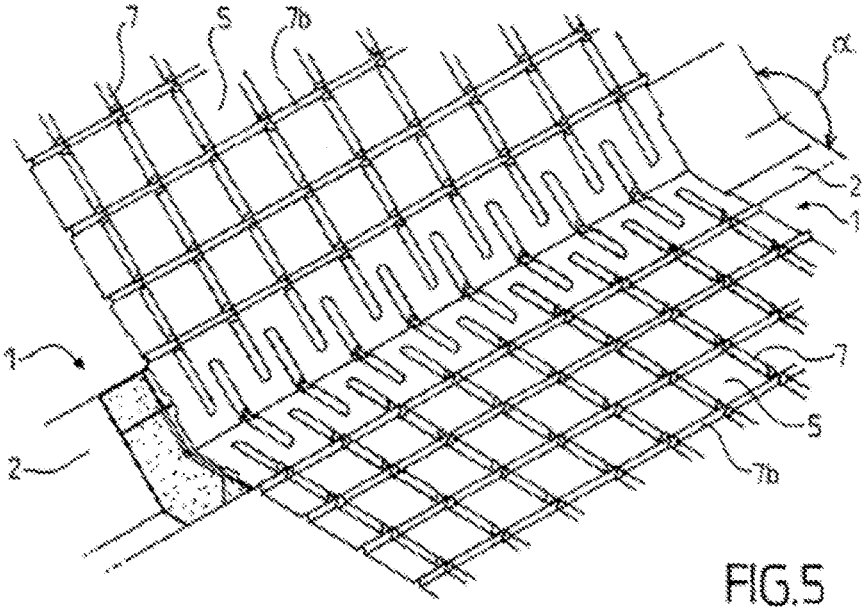
FIG. 5 is a schematic, cut-away perspective view of the corner connection of two walls, one of which is horizontal.

A cap 10 will now be described with reference to FIG. 4. In the same manner as the cap 9, the cap 10 comprises a peripheral base 21, which rests on the metal sheets 5 and 6 at one side and the other of the overlap zone 14. The cap 10 comprises an undulation portion 11 which is adapted to the undulation 8 of the metal sheet 6 and which decreases as far as the peripheral base 21 in order to form a terminal cap 19, which is also called a dome, arch or cupola.

The shaping of the caps 9 and 10 may be obtained by means of folding or by means of stamping, among others.

Again with reference to FIGS. 1 to 3, it is further possible to see the presence of undulations 7*b* and 8*b*, which are perpendicular to the undulations 7 and 8 on the metal sheets 5 and 6, respectively. The undulations 7*b* and 8*b* have features, which are similar or identical to the undulations 7 and 8. These undulations 7*b* and 8*b*, which are paired with the undulations 7 and 8, respectively, perform the function of supporting forces in all directions, in particular in the plane constituted by the sealing membrane.

The metal sheet 6 further has on the profile of the edge 17, in addition to the recess in the direction of the thickness of the metal sheet, notches 12 which surround the caps 9 and which are arranged in alignment with the undulations 7 of the metal sheets 5. These notches 12 are arranged alternately with the undulations 8.

These notches 12 are intended to facilitate the assembly of a metal sheet 6, which is placed on the insulating barrier 1 after the assembly of the metal sheets 5 and caps 9. The notches 12 are also intended to enable alignment discrepancies between the metal sheets 5 and 6. The dimension of the cut-out of the notches 12 is produced in order to provide sufficient play between the caps 9 and the edge of the cut-out. This play enables the same cut-out to be produced for all of the metal sheets and prevents the problems of alignment when the membrane is used, as a result of an excessively strict tolerance.

This is because the construction of a tank may be brought about in accordance with a plurality of procedures. For example, prefabricated blocks comprising from the carrier structure to the inner side of the tank a carrier wall 2 which is partially covered by an insulating barrier 1 and a sealed barrier 4 are positioned on the construction site. A peripheral zone of a prefabricated block is left accessible for the assembly operations of the two blocks of the carrier structure, the welding and the verification of the sealing. Then, the peripheral zone is filled with an insulator and covered with a sealed membrane. In a variant, the carrier structure is integrally assembled on the construction site. Subsequently, the insulation membrane 1, then the sealed barrier 4 are arranged on the inner face of the carrier structure. The operation may be optimized by the intervention using two teams which each start from one end of the tank wall. As these two examples show, it is complex to ensure the precise alignment required to connect the undulations of two metal sheets of insulating membranes. It is commonplace to encounter transverse discrepancies of alignment of up to 2 cm in one direction or the other. In this manner, the notches 12 are sized in order to enable a tolerance of a positioning discrepancy of ±2 cm in the longitudinal direction of the planar anchoring member 3.

The metal sheets 5 and 6 and the caps 9 and 10 are produced from sheet metal of stainless steel or aluminum, shaped by means of folding or by means of stamping. Other metals or alloys are also possible. By way of example, the metal sheets 5 and 6 have a thickness of approximately 1.2 mm. Other thicknesses can also be envisaged, taking into account that a thickening of the metal sheets 5 and 6 brings about an increase in the cost thereof and generally increases the rigidity of the undulations.

In a prefabricated embodiment, the undulations 7 are preferably finalized during assembly in the factory. In order to adjust the length of the sealed barrier 4 in the length of the tank, it is possible to cut the length opposite the closures of the undulations to the suitable length.

In a variant, the planar anchoring member 3 comprises a closure return member, which is welded in a sealed manner to the carrier structure. The closure enables the sealing of the pre-assembled portion of the block to be tested in the factory, before assembly at the construction site.

With reference to FIGS. 5 to 8, there will now be described by differentiation an embodiment in which the carrier wall 2 is composed of two faces, which form an angle α. The two faces, in this particular embodiment, are covered by an insulating barrier 1 and a sealed barrier 4.

The principle is to eliminate, or at least reduce, the continuity of the waves between faces but to retain the flexibility necessary for the correct operation of the membrane.

The insulating barrier 1 is, for example, a sandwich composed of polyurethane foam engaged between two plates of plywood, of which the wood is, for example, birch. The anchoring member 3 is fixed to the plywood plate, which is oriented toward the inner side of the tank.

The sealed barrier 4 is composed of non-coplanar metal sheets 5 which form a dihedron and fitted undulating connection components 25. The metal sheets 5 follow the two faces of the carrier wall 2. The metal sheets 5 are welded to an anchoring member 3.

The anchoring member 3, which is arranged in the region of the connection joint of the two faces of the carrier wall 2, is composed of a series of metal plates 30. These metal plates 30 form a dihedron whose angle between the two planes is the same angle alpha α which is present between the two faces of the dihedron of the carrier wall 2. The metal plates 30 are aligned in the longitudinal direction of the anchoring member. Two adjacent metal plates 30 each have a transverse edge which constitutes an interface between the two metal plates 30. At this interface, a gap 33 is provided in order to obtain resilience from the anchoring member in the longitudinal direction. In a variant, the edges at the interface are in contact, or welded.

The two transverse edges of each anchoring plate are arranged perpendicularly to the longitudinal direction of the anchoring member, that is to say, approximately parallel with the undulations 7 of the metal sheets 5. The interfaces of the plates are further arranged between two adjacent undulations 7 of a metal sheet 5.

The connection of a metal sheet 5 with respect to the anchoring member 3 is produced with an edging metal sheet 35 whose undulations are closed by caps 24. The caps 24 are welded to the metal sheet 35. In a variant, the caps 24 are mounted so as to straddle the metal sheet 35 and a metal plate 30 in accordance with the principle of the embodiment of FIG. 1 with the caps 9. Furthermore, the profile of the edge of the edging metal sheet 35 comprises notches 34, which alternate with the undulations 7. These notches 34 and the interfaces of the metal plates 30 are generally aligned. These notches 34 enable the resilience obtained to be retained using the gaps 33 in the region of the connection of the sealed barrier 4 with respect to the anchoring member 3.

Finally, in order to finalize the sealing, a fitted undulating connection component 25 is arranged in the region of the interface of two plates and the notches 34 of two plates facing each other.

Figure 8:
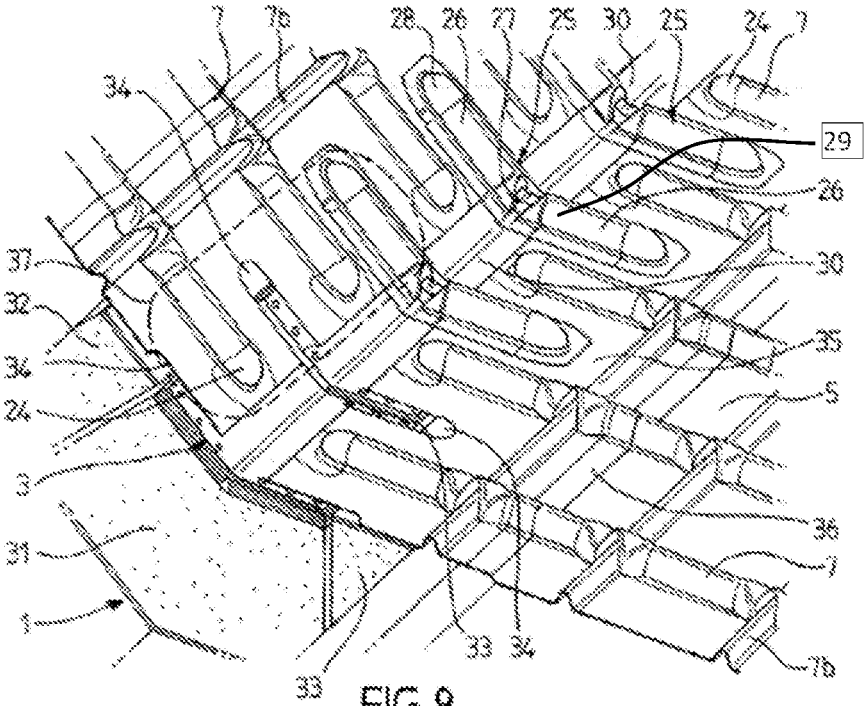
FIG. 8 is an enlarged view of a portion of FIG. 5.

The fitted undulating connection components 25 have a shape, which enables a degree of resilience to be ensured for the sealed barrier 4. In order to ensure the continuity of flexibility and retain the resilience of the sealed barrier 4, in the connection portion with the anchoring member 3, an end portion of the undulations 7 alternates with a portion of the connection components 25 in a zone 37. This zone in FIG. 8 is indicated by way of example. This is because it is advantageous to understand that it covers the entire edge of the connections produced between the metal sheets 5 and the anchoring member 3, at one side and the other of this anchoring member 3. In this manner, the sealed barrier 4 is capable of being subjected to forces in the region of the anchoring member 3.

The shape of an undulating connection component 25 is that of two upturned shells 29 which are joined using a bellows 27 having an angle α, which is intended to enable the forces to be received in the corner of the tank. For the production of such a connection component, all folding and stamping means can be used. The two shells may each be produced in one piece or with a cap 28, which is welded to a rectilinear wave portion 26. Then, they are assembled with the bellows 27, which is adapted for the value of the angle α.

This arrangement enables greater positioning tolerances between faces since there are no more waves to be connected.

Figure 6:
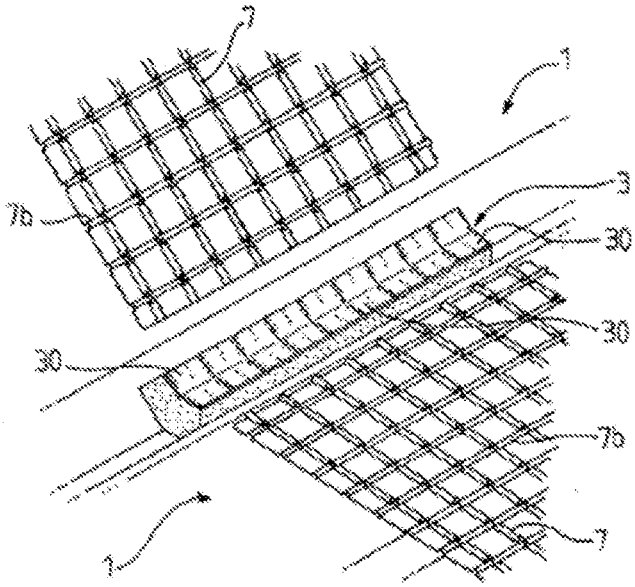
FIG. 6 is a schematic, perspective cut-away view of the step of positioning the insulating barrier of FIG. 5.
Figure 7:
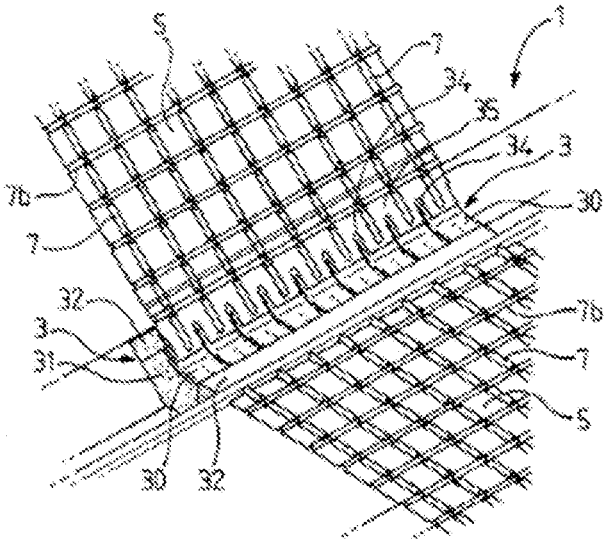
FIG. 7 is a schematic, perspective cut-away view of the step of connecting a first sealed membrane of FIG. 5.

The assembly of walls which form a dihedron of such a tank will now be described beginning with FIG. 6, in which two faces of a carrier wall 2 are either pre-equipped in the factory or provided on the construction site with an insulating membrane 1 and a sealed barrier 4 whose metal sheets 5 partially cover the insulating blocks. A peripheral zone at each block, which is constituted in particular by a face of carrier wall 2, is left free to enable the welding operations of the two adjacent faces.

Then, a first insulating corner block 31 is placed on the carrier wall 2. This block is provided with the anchoring member 3. Moving on to FIG. 7, it can be seen that at one side and the other of the insulating corner block 31, blocks 32 for taking up the play necessary for the assembly of the insulating corner block 31 are installed. The sealing membrane may be supplemented by the addition of a metal sheet 5, which ensures the continuity of the sealed barrier 4, up to overlapping the metal plates 30 of the anchoring member 3. The welded assembly between the metal sheet 5 and each metal plate 30 is produced in a sealed manner.

Finally, connection components 25 are welded in the same manner, in order to cover and ensure the sealing of the interface between two metal plates 30. A connection component 25 overlaps the two metal plates 30 and the interface of the two metal plates 30 and the metal sheets 5 in the region of the notches 34.

In a variant, the edge of the metal sheet 5, which covers the anchoring member 3 does not comprise the notches 34.

In a variant, the two faces of the carrier wall 2 are coplanar. The metal plates 30 which constitute the anchoring member 3 are then planar and the connection components 25 are rectilinear and do not comprise bellows. A connection component 25 may then be produced in a single stamped portion.

Figure 9:
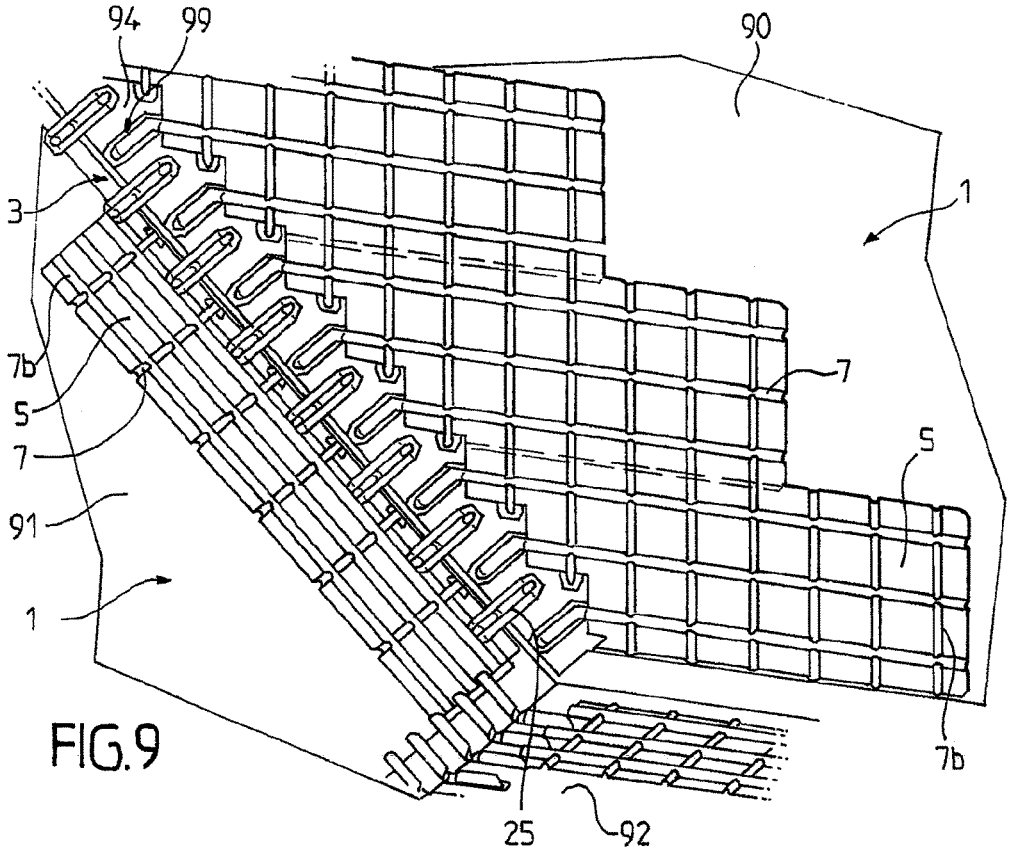
FIG. 9 is a schematic, perspective view of the connection of a vertical wall with an inclined wall.
Figure 10:
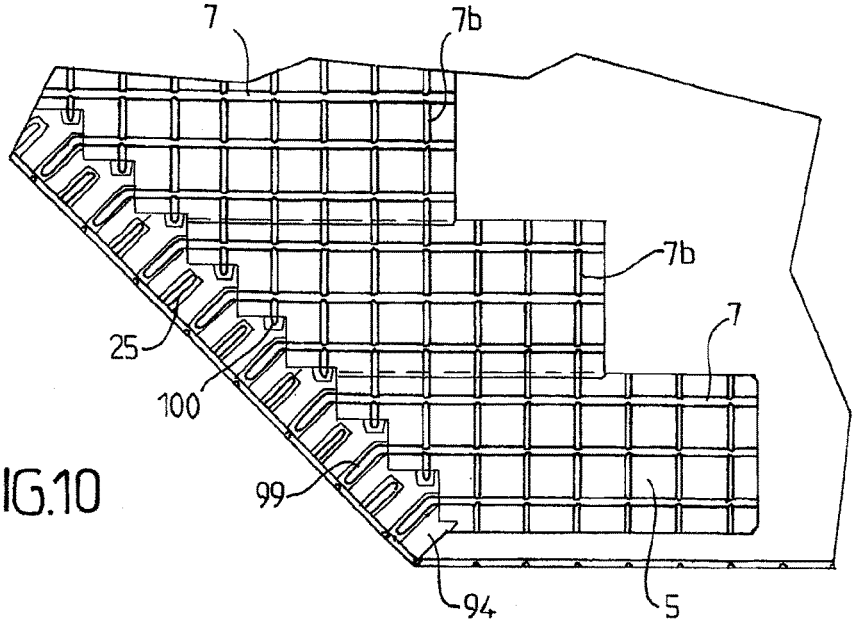
FIG. 10 is a front view of the vertical wall of FIG. 9.
Figure 11:
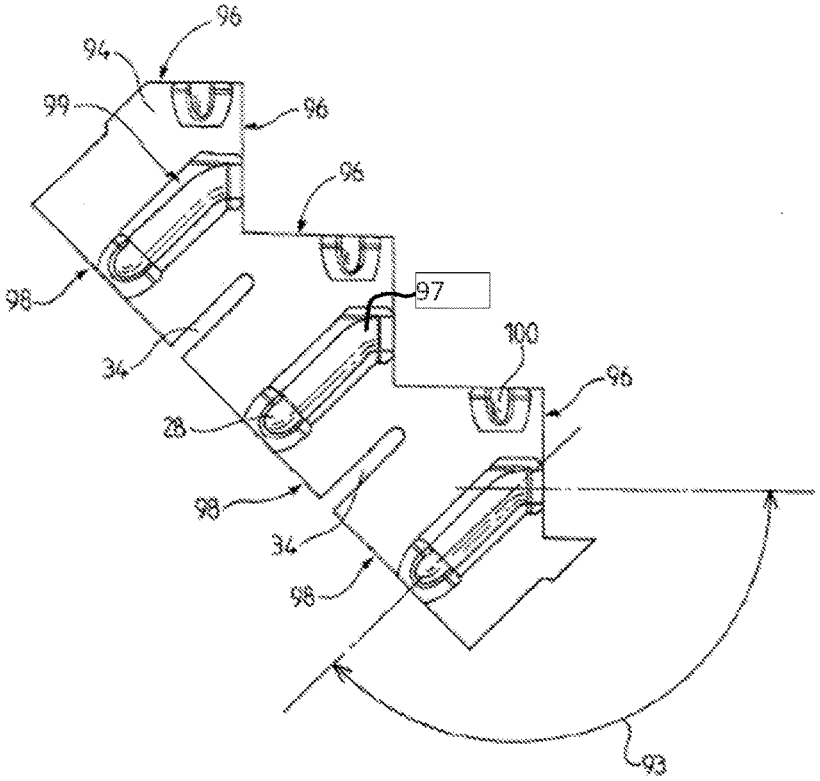
FIG. 11 is a front view of a detail of FIG. 9.

With reference to FIGS. 9 to 11, the connection of an inclined wall to a vertical wall will now be described. As before, the walls are constituted by metal sheets 5, which cover the insulating barrier 1. These metal sheets 5 comprise undulations 7 and 7*b*. As in the other embodiments, the alignment of the undulations 7 of the metal sheets 5 arranged on the wall 90 with the undulations of the metal sheets 5 arranged on the inclined wall 91 is problematic. This is because it would first require that the pitch between the undulations of the metal sheets of the wall 90 and that of the undulations of the metal sheets of the wall 91 be adapted in accordance with the inclination of the wall 91, which is also called a slope, relative to the horizontal. Then, it would be necessary to ensure precise alignment for the connection of the undulations. Finally, in the connection zone, the force taken up by the membrane is oriented in the longitudinal direction of the anchoring member. Consequently, in the connection zone, it is advantageous to have undulations of a perpendicular direction with respect to the longitudinal direction of the anchoring member for optimum efficiency. By adapting the grid pitch of the undulations between the metal sheets of the two walls, the criterion of perpendicular orientation of the undulations relative to the longitudinal direction of the anchoring member is not complied with.

In the illustration of FIG. 9, the wall 91 forms an angle of 135° with the base 92 of the tank. The pitch of the undulations on the slope is 480.8 mm. On the vertical wall 90, the horizontal undulations 7 are redirected by the same angle of 135°. To this end, an angle return component 94 is welded via the edge 96, in the continuation of the metal sheets 5. It is welded via the edge 98 to the anchoring member 3. The angle return component 94 comprises a bend portion 97.

The edge 98 is generally parallel with the longitudinal direction of the anchoring member 3.

The angle return component 94 enables the undulations 7 to be extended in accordance with an angle 93 using the undulations 99. The undulations 99 redirect the direction of the undulations 7 in the plane of the wall 90 in accordance with the angle 93 which is 135°.

In order to ensure the sealing of the connection with respect to the metal sheet 5, caps 100 close the undulations 7*b*. The return using the undulation 99 and the caps 100 enable the independence between two faces to be ensured. The flexibility is ensured by the overlapping of the undulations.

Notches 34 are arranged on the profile of the assembly edge 98 with the anchoring member 3. These notches 34 have the same features and functions as in the preceding embodiment. These notches 34 which are arranged in the region of the interface between two plates of the anchoring member 3 are covered to ensure sealing by fitted undulating connection components 25. The angle of the bellows 27 is 135°, corresponding to the angle between the two walls 90 and 91.

The angle return component 94, the metal sheet 5 and the anchoring member 3 are welded in a sealed manner.

This embodiment therefore also ensures assembly with large tolerances between dissociated faces.

In a variant, the angle 93 is adapted in accordance with the inclination of the slope, with respect to the floor. For example, it enables an angle return to be carried out having a value of 135°, 161.6°, 170.6° or 173.7°.

In a variant, any other grid pitch for producing undulations can be used, for example, a pitch of 340 mm, which is combined with other pitches or is identical over all of the faces of the tank.

This method of connection can also be used for an inclined wall from the roof of the tank toward the base of the tank. It enables a large degree of freedom in the selection of the geometry of the tank.

All of the embodiments enable the production of prefabricated sub-assemblies in factories, which are capable of carrying out the assembly on the construction site, which limits the manual welding operations in situ. It enables the problems of precise adjustment, which have to be carried out to be eliminated.

In a variant, the closure of the undulations may be obtained by any other means, which replaces the caps.

For the implementation of the membrane and more specifically the welding of the membrane, the use of an automated welding robot is possible. This is because the adapted shapes enable continuous welding to be produced on a planar surface. The connection welding operation may therefore be carried out in a rapid manner by a welding robot with an adapted travel path of the welding torch. The other welding operations can be carried out during pre-production. Therefore, there remain only the connection welds between two connection membranes, which may be produced with a conventional welding robot.

The technique described above for producing a sealing membrane may be used in different types of containers, for example, in order to constitute the primary sealing membrane of an LNG container in a ground-based installation or in a floating structure such as a methane tanker or the like.

Figure 12:
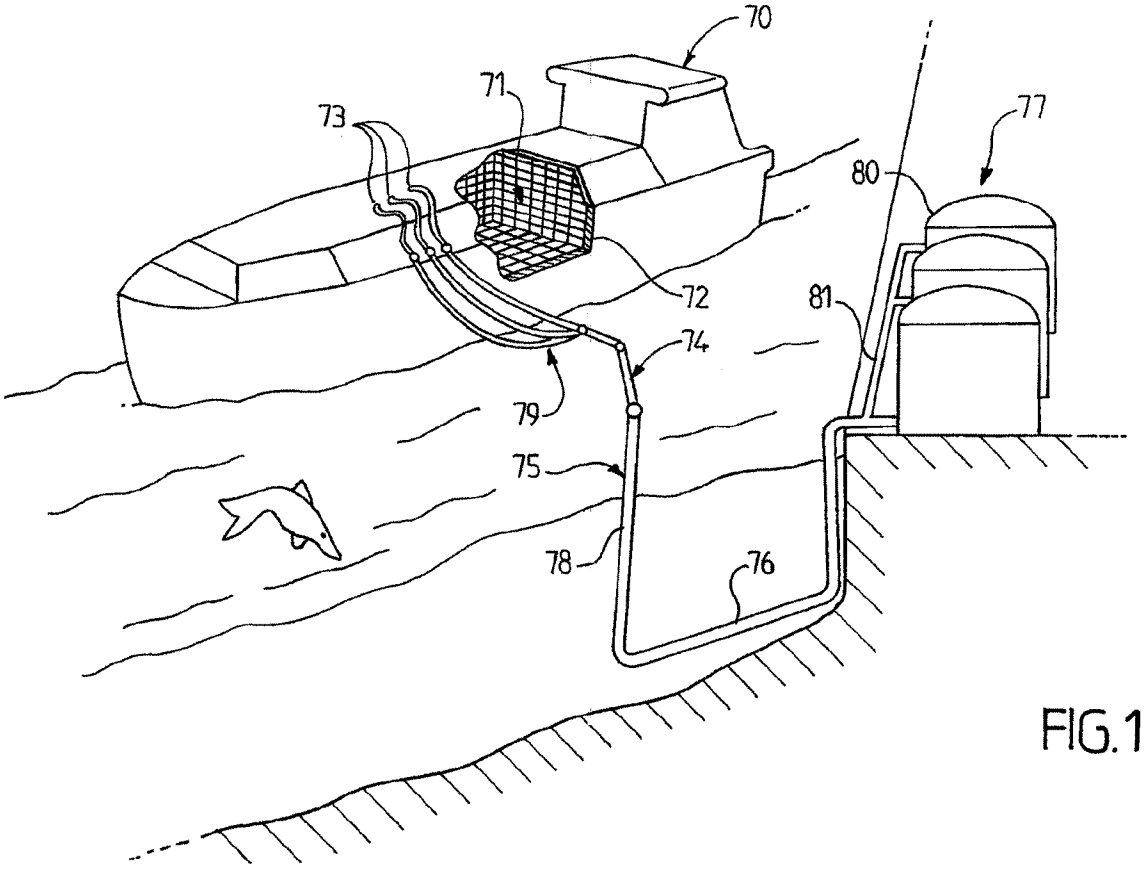
FIG. 12 is a schematic cut-away illustration of a tank of a methane tanker provided with a sealed and thermally insulated tank and a loading/unloading terminal of this tank.

With reference to FIG. 12, a cut-away view of a methane tanker 70 shows a sealed and insulated tank 71 of generally prismatic form, which is mounted in the double hull 72 of the tanker. The wall of the tank 71 comprises a primary sealed barrier which is intended to be in contact with the LNG contained in the tank, a secondary sealed barrier arranged between the primary sealed barrier and the double hull 72 of the tanker, and two insulating barriers which are arranged between the primary sealed barrier and the secondary sealed barrier, respectively, and between the secondary sealed barrier and the double hull 72.

In a manner known per se, loading/unloading channels 73, which are arranged on the upper bridge of the tanker may be connected, using appropriate connectors, to a sea-based or port-based terminal in order to transfer a cargo of LNG from or to the tank 71.

FIG. 12 shows an example of a sea-based terminal, which comprises a loading and unloading station 75, an underwater conduit 76 and a ground-based installation 77. The loading and unloading station 75 is a fixed off-shore installation comprising a movable arm 74 and a tower 78, which supports the movable arm 74. The movable arm 74 carries a bundle of flexible insulated pipes 79 which can be connected to the loading/unloading channels 73. The movable arm 74 which can be oriented is adapted to all the gauges of methane tankers. A connection conduit, which is not illustrated, extends inside the tower 78. The loading and unloading station 75 enables the loading and unloading of the methane tanker 70 from or to a ground-based installation 77. This comprises storage tanks 80 for liquefied gas and connection conduits 81 which are connected via the underwater conduit 76 to the loading or unloading station 75. The underwater conduit 76 enables liquefied gas to be transferred between the loading or unloading station 75 and the ground-based installation 77 over a great distance, for example, 5 km, which enables the methane tanker 70 to be kept at a great distance from the coast during the loading and unloading operations.

In order to produce the pressure required for the transfer of the liquefied gas, there are used pumps, which are on-board the tanker 70 and/or pumps with which the ground-based installation 77 is provided, and/or pumps with which the loading and unloading station 75 is provided.

Although the disclosure has been described in connection with several specific embodiments, it is clearly evident that it is by no means limited thereto and that it comprises all the equivalent techniques of the means described and their combinations if they are included within the scope of the disclosure.

The use of the verb "comprise", "contain" or "include" and the conjugated forms thereof does not exclude the presence of elements or steps other than those set out in a claim. The use of the indefinite article "a" or "an" for an element or a step, unless otherwise stated, does not exclude the presence of a plurality of such elements or steps.

In the claims, any reference numeral in brackets should not be interpreted to be a limitation of the claim.

The invention claimed is:

1. A sealed and thermally insulated tank, comprising:

a tank wall on a carrier structure, the tank wall extending from an outer side to an inner side, the tank wall comprising:

an insulating barrier which is retained on the carrier structure, the insulating barrier covering an inner surface of the carrier structure;

a sealed barrier which rests on the insulating barrier, and an anchoring member made of metal, the anchoring member being fixed to an upper surface of the insulating barrier, the sealed barrier comprising;

a first undulating metal membrane which is arranged on a first portion of the insulating barrier located at one side of the anchoring member;

a second undulating metal membrane which is arranged on a second portion of the insulating barrier located at the other side of the anchoring member and a first and a second plurality of caps;

the first membrane having an assembly edge which is arranged on the anchoring member, the assembly edge of the first membrane being welded in a sealed manner to the anchoring member;

the first membrane undulating with a first series of parallel undulations and a second series of parallel undulations, a direction of the first series of parallel undulations of the first membrane and a direction of the second series of parallel undulations of the first membrane intersecting, the direction of the first series of undulations of the first membrane intersects with the assembly edge of the first membrane;

the second membrane undulating with a first series of parallel undulations and a second series of parallel undulations, a direction of the first series of parallel undulations of the second membrane and a direction of the second series of parallel undulations of the second membrane intersecting, the direction of the first series of undulations of the second membrane intersects with an assembly edge of the second membrane;

each of the caps comprising a metal component which has a terminal undulation portion in the form of a dome, which is intended to be connected to the respective undulation which the cap closes and which descends as far as a base plate which surrounds the terminal undulation portion;

characterized in that the anchoring member is elongate in a longitudinal direction;

the assembly edge of the first membrane being oriented parallel with the longitudinal direction of the anchoring member, each undulation of the first series of undulations of the first membrane being closed in a sealed manner by a respective cap of the first plurality of caps which is arranged along the assembly edge of the first membrane;

the assembly edge of the second membrane comprising advance portions in the longitudinal direction of the anchoring member, said advanced portions covering the first membrane, the assembly edge of the second membrane further comprising recessed portions which alternate with the advanced portions and which are located in a continuation of the first series of undulations of the first membrane, each recessed portion exposing a corresponding sealed zone of the anchoring member, the caps of the first plurality of caps each time overlapping the first membrane and the corresponding sealed zone of the anchoring member exposed by the recessed portion, the advanced portions being located in alignment of the first series of undulations of the second membrane, each undulation of the first series of undulations of the second membrane being closed in a sealed manner by a respective cap of the second plurality of caps which is arranged along the assembly edge of the second membrane, the caps of the second plurality of caps overlapping each time the first membrane and a respective advanced portion; and the terminal undulation portions of the caps of the first plurality of caps, which terminal undulation portions of the caps of the first plurality of caps are associated with the first series of undulations of the first membrane, extending in a direction transverse to the assembly edge of the first membrane in the direction of the second membrane, beyond the terminal undulation portions of the caps of the second plurality of caps.

2. The tank as claimed in claim 1, wherein the undulations of the first series of undulations of the second membrane are not aligned with the undulations of the first series of undulations of the first membrane in order to form an offset in a direction parallel with the assembly edge.

3. The tank as claimed in claim 2, wherein the offset is equal to half of a spacing of the undulations of the first series of undulations of the first membrane.

4. The tank as claimed in claim 1, wherein the first series of undulations of the membranes is perpendicular to the assembly edge of the membranes.

5. The tank as claimed in claim 1, wherein each undulation of the first series of undulations of the first membrane comprises a first rectilinear portion, a bend and a second rectilinear portion, and wherein the bend has an angle which is capable of orienting the second rectilinear portion perpendicularly to the assembly edge of the first membrane.

6. The tank as claimed in claim 1, wherein the direction of the second series of undulations of the second membrane is parallel with the direction of the second series of undulations of the first membrane.

7. The tank as claimed in claim 1, wherein the first series of undulations of the first membrane is perpendicular to the assembly edge of the first membrane and the second series of undulations of the first membrane is parallel with the assembly edge of the first membrane and wherein the first series of undulations of the second membrane is perpendicular to the assembly edge of the second membrane and the second series of undulations of the second membrane is parallel with the assembly edge of the second membrane.

8. The tank as claimed in claim 1, wherein the direction of the first series of undulations of the second membrane is parallel with the direction of the first series of undulations of the first membrane.

9. The tank as claimed in claim 1, wherein the undulations of the first series of undulations of the membranes are spaced at regular intervals.

10. A tanker for the transport of a cold liquid product, the tanker comprising:

a double hull; and a tank arranged in the double hull, the tank comprising:

a tank wall on a carrier structure, the tank wall extending from an outer side to an inner side, the tank wall comprising;

an insulating barrier which is retained on the carrier structure, the insulating barrier covering an inner surface of the carrier structure;

a sealed barrier which rests on the insulating barrier, and an anchoring member made of metal, the anchoring member being fixed to an upper surface of the insulating barrier, the sealed barrier comprising;

a first undulating metal membrane which is arranged on a first portion of the insulating barrier located at one side of the anchoring member;

a second undulating metal membrane which is arranged on a second portion of the insulating barrier located at the other side of the anchoring member and a first and a second plurality of caps;

the first membrane having an assembly edge which is arranged on the anchoring member, the assembly edge of the first membrane being welded in a sealed manner to the anchoring member;

the first membrane undulating with a first series of parallel undulations and a second series of parallel undulations, a direction of the first series of parallel undulations of the first membrane and a direction of the second series of parallel undulations of the first membrane intersecting, the direction of the first series of undulations of the first membrane intersects with the assembly edge of the first membrane;

the second membrane undulating with a first series of parallel undulations and a second series of parallel undulations, a direction of the first series of parallel undulations of the second membrane and a direction of the second series of parallel undulations of the second membrane intersecting, the direction of the first series of undulations of the second membrane with an assembly edge of the second membrane;

each of the caps comprising a metal component which has a terminal undulation portion in the form of a dome, which is intended to be connected to the respective undulation which the cap closes and which descends as far as a base plate which surrounds the terminal undulation portion;

characterized in that the anchoring member is elongate in a longitudinal direction;

the assembly edge of the first membrane being oriented parallel with the longitudinal direction of the anchoring member, each undulation of the first series of undulations of the first membrane being closed in a sealed manner by a respective cap of the first plurality of caps which is arranged along the assembly edge of the first membrane;

the assembly edge of the second membrane comprising advance portions in the longitudinal direction of the anchoring member, said advanced portions covering the first membrane, the assembly edge of the second membrane further comprising recessed portions which alternate with the advanced portions and which are located in a continuation of the first series of undulations of the first membrane, each recessed portion exposing a corresponding sealed zone of the anchoring member, the caps of the first plurality of caps each time overlapping the first membrane and the corresponding sealed zone of the anchoring member exposed by the recessed portion, the advanced portions being located in alignment of the first series of undulations of the second membrane, each undulation of the first series of undulations of the second membrane being closed in a sealed manner by a respective cap of the second plurality of caps which is arranged along the assembly edge of the second membrane, the caps of the second plurality of caps overlapping each time the first membrane and a respective advanced portion; and the terminal undulation portions of the caps of the first plurality of caps, which terminal undulation portions of the caps of the first plurality of caps are associated with the first series of undulations of the first membrane, extending in a direction transverse to the assembly edge of the first membrane in the direction of the second membrane, beyond the terminal undulation portions of the caps of the second plurality of caps.

11. A method for loading or unloading a tanker for the transport of a cold liquid product, the method comprising:

conveying a cold liquid product through insulated channels from or to a floating or ground-based storage installation to or from a tank within a double hull of the tanker, the tank comprising:

a tank wall on a carrier structure, the tank wall extending from an outer side to an inner side, the tank wall comprising;

an insulating barrier which is retained on the carrier structure, the insulating barrier covering an inner surface of the carrier structure;

a sealed barrier which rests on the insulating barrier, and an anchoring member made of metal, the anchoring member being fixed to an upper surface of the insulating barrier, the sealed barrier comprising;

a first undulating metal membrane which is arranged on a first portion of the insulating barrier located at one side of the anchoring member;

a second undulating metal membrane which is arranged on a second portion of the insulating barrier located at the other side of the anchoring member and a first and a second plurality of caps;

the first membrane having an assembly edge which is arranged on the anchoring member, the assembly edge of the first membrane being welded in a sealed manner to the anchoring member;

the first membrane undulating with a first series of parallel undulations and a second series of parallel undulations, a direction of the first series of parallel undulations of the first membrane and a direction of the second series of parallel undulations of the first membrane intersecting, the direction of the first series of undulations of the first membrane intersects with the assembly edge of the first membrane;

the second membrane undulating with a first series of parallel undulations and a second series of parallel undulations, a direction of the first series of parallel undulations of the second membrane and a direction of the second series of parallel undulations of the second membrane intersecting, the direction of the first series of undulations of the second membrane intersects with an assembly edge of the second membrane;

each of the caps comprising a metal component which has a terminal undulation portion in the form of a dome, which is intended to be connected to the respective undulation which the cap closes and which descends as far as a base plate which surrounds the terminal undulation portion;

characterized in that the anchoring member is elongate in a longitudinal direction;

the assembly edge of the first membrane being oriented parallel with the longitudinal direction of the anchoring member, each undulation of the first series of undulations of the first membrane being closed in a sealed manner by a respective cap of the first plurality of caps which is arranged along the assembly edge of the first membrane;

the assembly edge of the second membrane comprising advance portions in the longitudinal direction of the anchoring member, said advanced portions covering the first membrane, the assembly edge of the second membrane further comprising recessed portions which alternate with the advanced portions and which are located in a continuation of the first series of undulations of the first membrane, each recessed portion exposing a corresponding sealed zone of the anchoring member, the caps of the first plurality of caps each time overlapping the first membrane and the corresponding sealed zone of the anchoring member exposed by the recessed portion, the advanced portions being located in alignment of the first series of undulations of the second membrane, each undulation of the first series of undulations of the second membrane being closed in a sealed manner by a respective cap of the second plurality of caps which is arranged along the assembly edge of the second membrane, the caps of the second plurality of caps overlapping each time the first membrane and a respective advanced portion; and the terminal undulation portions of the caps of the first plurality of caps, which terminal undulation portions of the caps of the first plurality of caps are associated with the first series of undulations of the first membrane, extending in a direction transverse to the assembly edge of the first membrane in the direction of the second membrane, beyond the terminal undulation portions of the caps of the second plurality of caps.

12. A transfer system for a cold liquid product, the system comprising:

a tanker having a double hull and a tank arranged in the double hull, the tank comprising:

a tank wall on a carrier structure, the tank wall extending from an outer side to an inner side, the tank wall comprising;

an insulating barrier which is retained on the carrier structure, the insulating barrier covering an inner surface of the carrier structure;

a sealed barrier which rests on the insulating barrier, and an anchoring member made of metal, the anchoring member being fixed to an upper surface of the insulating barrier, the sealed barrier comprising;

a first undulating metal membrane which is arranged on a first portion of the insulating barrier located at one side of the anchoring member;

a second undulating metal membrane which is arranged on a second portion of the insulating barrier located at the other side of the anchoring member and a first and a second plurality of caps;

the first membrane having an assembly edge which is arranged on the anchoring member, the assembly edge of the first membrane being welded in a sealed manner to the anchoring member;

the first membrane undulating with a first series of parallel undulations and a second series of parallel undulations, a direction of the first series of parallel undulations of the first membrane and a direction of the second series of parallel undulations of the first membrane intersecting, the direction of the first series of undulations of the first membrane intersects with the assembly edge of the first membrane;

the second membrane undulating with a first series of parallel undulations and a second series of parallel undulations, a direction of the first series of parallel undulations of the second membrane and a direction of the second series of parallel undulations of the second membrane intersecting, the direction of the first series of undulations of the second membrane intersects with an assembly edge of the second membrane;

each of the caps comprising a metal component which has a terminal undulation portion in the form of a dome, which is intended to be connected to the respective undulation which the cap closes and which descends as far as a base plate which surrounds the terminal undulation portion;

characterized in that the anchoring member is elongate in a longitudinal direction;

the assembly edge of the first membrane being oriented parallel with the longitudinal direction of the anchoring member, each undulation of the first series of undulations of the first membrane being closed in a sealed manner by a respective cap of the first plurality of caps which is arranged along the assembly edge of the first membrane;

the assembly edge of the second membrane comprising advance portions in the longitudinal direction of the anchoring member, said advanced portions covering the first membrane, the assembly edge of the second membrane further comprising recessed portions which alternate with the advanced portions and which are located in a continuation of the first series of undulations of the first membrane, each recessed portion exposing a corresponding sealed zone of the anchoring member, the caps of the first plurality of caps each time overlapping the first membrane and the corresponding sealed zone of the anchoring member exposed by the recessed portion, the advanced portions being located in alignment of the first series of undulations of the second membrane, each undulation of the first series of undulations of the second membrane being closed in a sealed manner by a respective cap of the second plurality of caps which is arranged along the assembly edge of the second membrane, the caps of the second plurality of caps overlapping each time the first membrane and a respective advanced portion; and the terminal undulation portions of the caps of the first plurality of caps, which terminal undulation portions of the caps of the first plurality of caps are associated with the first series of undulations of the first membrane, extending in a direction transverse to the assembly edge of the first membrane in the direction of the second membrane, beyond the terminal undulation portions of the caps of the second plurality of caps;

insulated channels which are arranged so as to connect the tank to a floating or ground-based storage installation; and a pump for driving a flow of cold liquid product through the insulated channels from or to the floating or ground-based storage installation to or from the tank of the tanker.

* * * * *